US009884754B2

(12) United States Patent
Törngren

(10) Patent No.: US 9,884,754 B2
(45) Date of Patent: Feb. 6, 2018

(54) DISPENSING GUN

(71) Applicant: Identic AB, Vallentuna (SE)

(72) Inventor: Mats Törngren, Stockholm (SE)

(73) Assignee: Identic AB, Vallentuna (SE)

( * ) Notice: Subject to any disclaimer, the term of this patent is extended or adjusted under 35 U.S.C. 154(b) by 0 days.

(21) Appl. No.: 15/120,987

(22) PCT Filed: Feb. 23, 2015

(86) PCT No.: PCT/SE2015/050203
§ 371 (c)(1),
(2) Date: Aug. 23, 2016

(87) PCT Pub. No.: WO2015/130209
PCT Pub. Date: Sep. 3, 2015

(65) Prior Publication Data

US 2016/0355391 A1 Dec. 8, 2016

(30) Foreign Application Priority Data

Feb. 26, 2014 (SE) ..... 1450223

(51) Int. Cl.
*B67D 7/54* (2010.01)
*B67D 7/04* (2010.01)

(52) U.S. Cl.
CPC ..... *B67D 7/54* (2013.01); *B67D 7/04* (2013.01)

(58) Field of Classification Search
CPC ..... B67D 7/54; B67D 7/04; F15B 1/00; F16L 55/04; F16L 55/043; F16L 55/045; F16L 55/054
USPC ..... 138/31
See application file for complete search history.

(56) References Cited

U.S. PATENT DOCUMENTS 404,969 A * 6/1889 Hattersley ..... 137/593
912,502 A * 2/1909 Squires ..... 138/31
1,776,937 A * 9/1930 Timbs ..... F04B 11/0033 137/539
1,963,270 A * 6/1934 Huffman ..... F16K 24/04 138/31
2,700,488 A * 1/1955 Rafferty ..... B67D 7/763 137/493.5

(Continued)

FOREIGN PATENT DOCUMENTS

CN 2892826 Y 4/2007
CN 102438935 A 5/2012
GB 455753 A 10/1936

OTHER PUBLICATIONS

International Search Report and Written Opinion received for PCT Patent Application PCT/SE2015/050203, dated May 12, 2015, 9 pages.

(Continued)

*Primary Examiner* — Timothy L Maust
*Assistant Examiner* — Andrew StClair
(74) *Attorney, Agent, or Firm* — Morrison & Foerster LLP

(57) ABSTRACT

The present disclosure relates to a dispensing gun with increased safety. The dispensing gun comprises an expansion chamber into which liquid trapped inside the dispensing gun can escape in case of expansion of said liquid, thereby avoiding an increase of pressure inside the dispensing gun resulting from such an expansion which could damage internal components, such as the outlet valve arrangement.

12 Claims, 4 Drawing Sheets

(56) References Cited

U.S. PATENT DOCUMENTS 2,884,955 A * 5/1959 Yost ..... F16L 55/052 138/31
3,630,235 A * 12/1971 Wiley ..... F16L 55/04 138/31
4,068,687 A * 1/1978 Long ..... B67D 7/48 141/206
4,700,757 A * 10/1987 Kudo ..... B67D 7/04 141/311 R
4,877,160 A * 10/1989 Derving ..... B65B 39/001 137/512.3
5,143,258 A 9/1992 Mittermaier
6,047,906 A * 4/2000 Plager ..... B05B 1/323 239/533.2
6,158,631 A * 12/2000 Varini ..... B05B 15/066 222/526
8,844,587 B1 * 9/2014 McCommons ..... B67D 7/42 141/207
9,091,355 B2 * 7/2015 Albrecht ..... F16K 17/04
2010/0224280 A1 * 9/2010 Burris ..... B67D 7/52 141/1
2012/0168028 A1 * 7/2012 Eum ..... B67D 7/0478 141/59

OTHER PUBLICATIONS

International Preliminary Report on Patentability received for PCT Patent Application No. PCT/SE2015/050203, dated Sep. 9, 2016, 7 pages.
Office Action received for Chinese Patent Application No. 201580009125.3, dated Aug. 2, 2017, 5 pages of official copy only. (See Communication Under 37 CFR § 1.98(a) (3)).

* cited by examiner

Fig. 2a
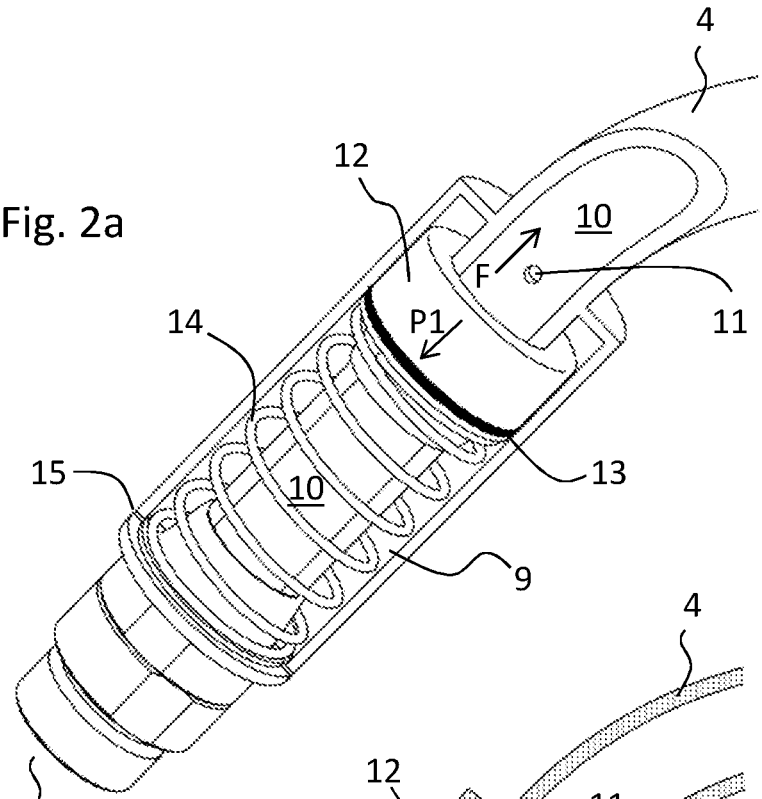
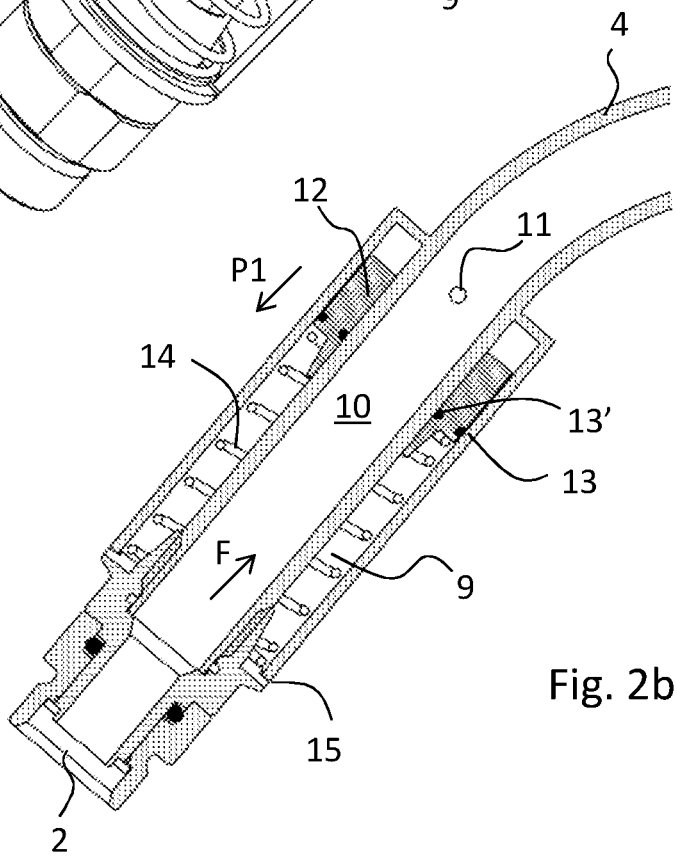
Fig. 2b

Fig. 4a
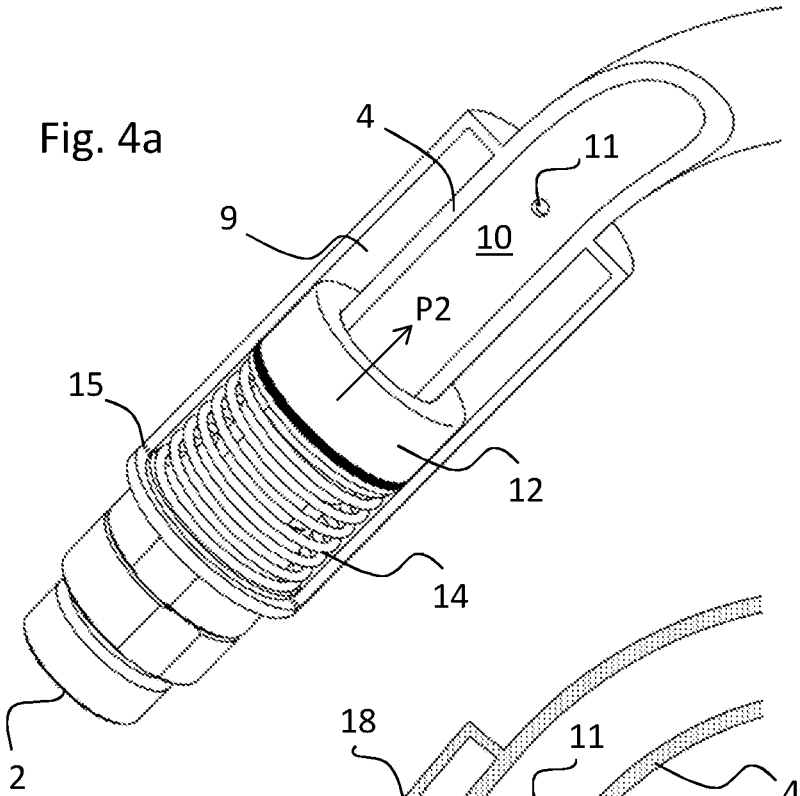
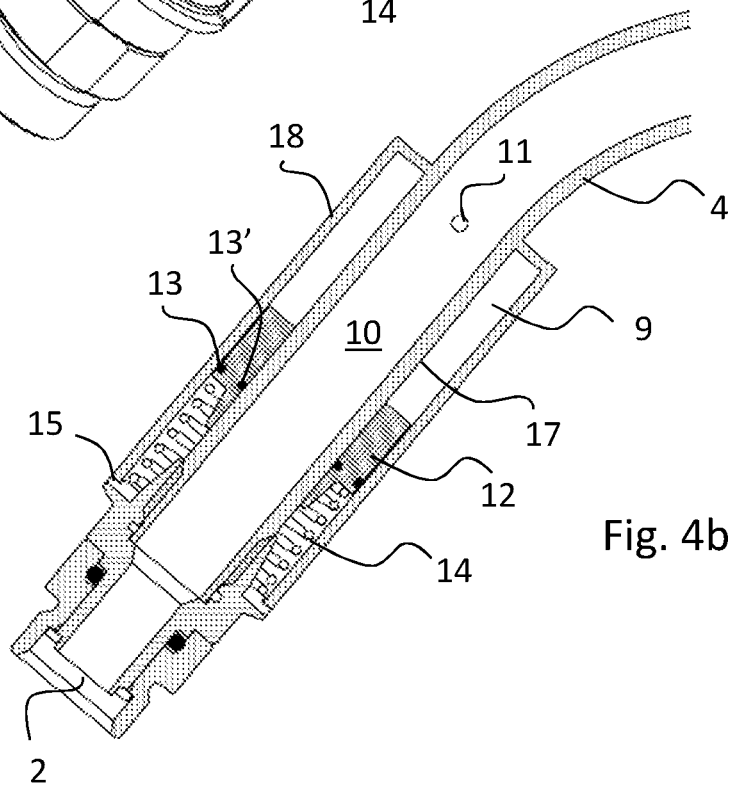
Fig. 4b

DISPENSING GUN

CROSS-REFERENCE TO RELATED APPLICATION

This application is a U.S. National Stage patent application of PCT/SE2015/050203 filed on Feb. 23, 2015, the entire contents of which are incorporated herein by reference.

TECHNICAL FIELD

The present disclosure relates in general to a dispensing gun, such as a dispensing gun for delivering liquids, for example fuel, to a vehicle, a container or the like. More specifically, the dispensing gun may be a nozzle adapted to be fitted for example to a metering pump and dispenser installed at a fuel filling station and may as such be used to dispense liquid fuel into tanks of motor vehicles, boats and light aircraft as well as into portable containers.

BACKGROUND

Conventional dispensing guns for dispensing fuels, such as petrol or diesel, may often suffer from spillage of fuel due to fuel dripping from the delivery tube after the delivery of fuel has been stopped, for example by an automatic shut-off arrangement. Even though this is not desirable and may present a small risk of flammable liquid being subjected to an unprotected environment it is generally acceptable with a small leakage of such fuels.

However, in light of the development of new alternative fuels, even such a small leakage may have a detrimental effect and must be avoided. Therefore, various solutions of dispensing guns comprising for example complex outlet valve arrangements and/or means for securing a liquid tight coupling between the dispensing gun and the recipient of the fuel have been developed in recent times. The outlet valve arrangement and/or said securing means of the dispensing guns ensures that no leakage can occur, for example by ensuring that no liquid can be present outside of the outlet valve of the dispensing gun after a dispensing procedure. This can for example be achieved by ensuring that a dispensing procedure is only possible when a coupling part of the dispensing gun has been firmly coupled to a corresponding coupling part associated with the fuel tank of a vehicle, and that the dispensing gun cannot be released before the outlet valve has been completely closed. The outlet valves are often some type of poppet valve. The result of this development is also that any release of a potential overpressure in a dispensing device cannot be made through the dispensing end of the dispensing gun.

Furthermore, there is a demand from a Weights & Measures approvable point of view that none of the measured fuel volume to be dispensed during a dispensing procedure should be able to return to the storage tank of the fuelling facility (or being dispensed through the gun un-measured) thereby ensuring that a customer will receive a correct amount of fuel.

Therefore, a volume of fuel will be trapped between the outlet valve of the dispensing gun and a shut off valve (for example volume measuring device, pump, etc) in the dispenser, or an inlet valve in the dispensing gun, when the dispensing gun has been used for a dispensing procedure.

The trapped liquid may under certain circumstances present a problem. More specifically, the trapped liquid may due to temperature changes expand which in turn may cause a risk of damaging the outlet valve or any other internal component of the dispensing gun. A damage of the outlet valve may in turn influence the operation of the dispensing gun during dispensing of fuel, or ultimately cause a leakage of fuel even when the dispensing gun is not in operation.

The problem of increased pressure resulting from expansion of fuels due to temperature changes is previously known in certain components, other than the dispensing gun, of a fuel dispenser, such as in the hose arranged between the pump and the dispensing gun. It has previously been proposed to solve such problems by arranging some type of pressure relief arrangement, such as an expansion chamber or the like, inside the housing of the fuel dispenser. One such example is disclosed in U.S. Pat. No. 1,963,270 describing a pressure relief attachment arranged between the pump and the hose. Such an expansion chamber is often quite bulky and thus space consuming. Furthermore, while such an expansion chamber works very well in a dispensing system comprising a conventional dispensing gun where a small leakage of fuel is possible, such an expansion chamber may be insufficient in cases where the dispensing gun of a dispensing system is constructed for liquid-tight dispense of fuels. In the latter case, a rise of pressure caused by expansion of liquid may cause damage to components before the increased built-up pressure is equalised in the system and/or a pressure relief arrangement in the fuel dispenser housing is able to compensate for such a rise of pressure.

Furthermore, with the recent developments of dispensing guns, certain dispensing guns may be constructed such that they will comprise a volume of fuel trapped between the outlet and the inlet of the dispensing gun between two dispensing procedures. This may for example be the case where the inlet of the dispensing gun comprises an inlet valve adapted to be closed between to dispensing procedures or if the device measuring the volume dispensed during a dispensing procedure is arranged at or close to the inlet of the dispensing gun instead of at the dispenser end of the hose. It has previously not been considered that expansion of the comparatively small volume trapped inside a dispensing gun may cause any considerable problems. However, with the recent development of dispensing guns ensuring completely liquid-tight guns and couplings thereof, the dispensing guns have become more complex. Arrangement of expansion chambers for example at the end of the hose connected to the metering pump of the dispenser cannot solve the problem of expansion of liquid trapped inside the dispensing gun.

Thus, there is a need to increase the safety of dispensing guns both during a dispensing procedure and between two dispensing procedures.

SUMMARY

The object of the present invention is to increase the safety of a dispensing gun.

The object is achieved by the dispensing gun as defined by claim 1. Embodiments are defined by the dependent claims.

The dispensing gun comprises an inlet adapted to be connected to means for delivering liquid to the dispensing gun, an outlet adapted to be inserted into and/or connected to a recipient of a liquid to be dispensed by the dispensing gun during a dispensing procedure, a housing, a central body piping arranged at least partly inside the housing and forming a main flow path for the liquid to be dispensed from the inlet to the outlet, and an outlet valve arrangement arranged at or in proximity of the outlet. The dispensing gun furthermore comprises an expansion chamber which is arranged such that it is separated from the main flow path and from the outlet valve arrangement. The expansion chamber is adapted to be in liquid communication with the main flow path via at least one through-hole in the central body piping for allowing liquid to enter said expansion chamber in case of expansion of liquid contained in the main flow path.

By means of the dispensing gun according to the present invention, it is ensured that the liquid is allowed to expand without increasing the pressure inside the central body piping which could cause damages to for example the outlet valve arrangement or a connection body at the inlet of the dispensing gun. The liquid is instead allowed to partly escape from the main flow path into the expansion chamber, thereby securing that the pressure inside the central body piping is kept at a safe level. Thus, the expansion chamber is arranged such that liquid may escape out of the central body piping via the through-hole in the central body piping to the expansion chamber in case of expansion.

The expansion chamber is preferably divided into a first and a second portion. The first portion is adapted to receive liquid from the main flow path in case of expansion of liquid contained in the main flow path between two dispensing operations. The first portion is preferably liquid tight except for the fluid communication with the main flow path. The second portion is adapted to not receive any liquid from the main flow path and may for example contain air.

Furthermore, the expansion chamber preferably comprises a piston which divides the expansion chamber into said first and second portions. The piston is preferably movable in a first direction in response to an expansion of liquid contained in the main flow path. Thus, liquid which enters the expansion chamber as a result of the expansion of the liquid inside the main flow path forces the piston to move in said first direction, thereby increasing the volume of the first portion of the expansion chamber while decreasing the volume of the second portion of the expansion chamber. The piston is suitably arranged to move in said first direction until there is essentially no pressure difference between the first portion of the expansion chamber, i.e. the portion of the expansion chamber adapted to temporarily receive liquid, and the main flow path.

In order to ensure that the piston is returned to its original position when the pressure from the expanding liquid decreases, for example during a dispensing procedure during which there is a flow of liquid which is dispensed in the main flow path of the dispensing gun, the piston is preferably spring loaded. The spring load can also ensure that only a required volume of liquid to obtain the desired result of avoiding increase of pressure in the central body piping is allowed to enter into the expansion chamber by providing a counter-acting force on the piston when it moves in the first direction.

According to one embodiment, the expansion chamber is essentially circular cylindrical and concentrically arranged with a central axis of the central body piping. The expansion chamber is thus essentially in the form of a hollow cylinder. This inter alia saves space and ensures that the expansion chamber can be integrated into the housing of the dispensing gun without effecting the usability of the dispensing gun.

Preferably, an outer surface of the central body piping at least partially forms a first wall of the expansion chamber meaning that said wall both constitutes a part of the central body piping and the expansion chamber. Thereby, space can be saved and the weight of the dispensing gun be kept low since there need not be a separate inner wall member of the expansion chamber. Moreover, the fluid communication between the main flow path and the expansion chamber can be facilitated by the possibility of arranging the through-hole of the central body piping in the shared wall which constitutes the first wall of the expansion chamber. The through-hole may be arranged such that it opens into an upper portion of the expansion chamber, i.e. the portion of the expansion chamber which is closest to the outlet end of the dispensing gun. Alternatively, the through-hole may be arranged such that it opens into a lower portion of the expansion chamber, i.e. a portion of the expansion chamber which is closest to the inlet end of the dispensing gun.

According to an embodiment, the piston is adapted to be located essentially over the at least one through-hole during a dispensing procedure. This further aids in preventing liquid from flowing into the expansion chamber during a dispensing procedure. However, there should be a small gap between the piston and the opening of the through-hole into the expansion chamber to ensure that liquid is sufficiently able to enter the expansion chamber in case of expansion of the liquid present in the main flow path between two dispensing operations.

According to one embodiment, the expansion chamber further comprises at least one ventilation hole arranged in a wall of the expansion chamber in the second portion of the expansion chamber which is adapted to not receive any liquid from the main flow path. Thereby, it is ensured that the air in said second portion is allowed to escape therefrom when the piston moves in the first direction such that the volume of the second portion is decreased, thus avoiding the risk of undesired pressure build-up in the second portion of the expansion chamber.

In order to ensure that no liquid is capable of escaping from the first portion to the second portion of the expansion chamber, the piston is preferably provided with sealing means, such as at least one O-ring, to provide a liquid-tight seal between the piston and a wall of the expansion chamber. Other types of sealing means are also plausible as known in the art, and may for example comprise at least one radial protrusion of the piston.

According to another embodiment, the piston is preferably essentially circular cylindrical and comprises a central hole, i.e. essentially constitutes a hollow cylinder. This makes sure that the piston can provide a dividing wall between the first and the second portion of the expansion chamber even when the expansion chamber is essentially cylindrical and concentrically arranged with the central axis of the central body piping.

The dispensing gun according to the present invention is suitable for dispensing any type of liquid. However, it is primarily developed for dispensing flammable, toxic and/or explosive liquids, such as fuels comprising alcohol or alcoholic mixtures.

BRIEF DESCRIPTION OF DRAWINGS

FIG. 2*a* schematically illustrates a perspective view of an expansion chamber in a first state where the piston is in its original position.

FIG. 2*b* schematically illustrates a cross sectional view of the expansion chamber of FIG. 2*a*.

FIG. 4*a* schematically illustrates a perspective view of an expansion chamber in a second state where the piston has moved to a second position.

FIG. 4*b* schematically illustrates a cross sectional view of the expansion chamber of FIG. 4*a*.

DETAILED DESCRIPTION

The present invention will be described in more detail below with reference to the accompanying drawings. The drawings shall not be considered drawn to scale as some features may have been exaggerated in order to more clearly illustrate the invention.

Furthermore, the invention is not limited to the specific embodiments shown in the figures and discussed below but may be varied within the scope of the appended claims.

Figure 1:
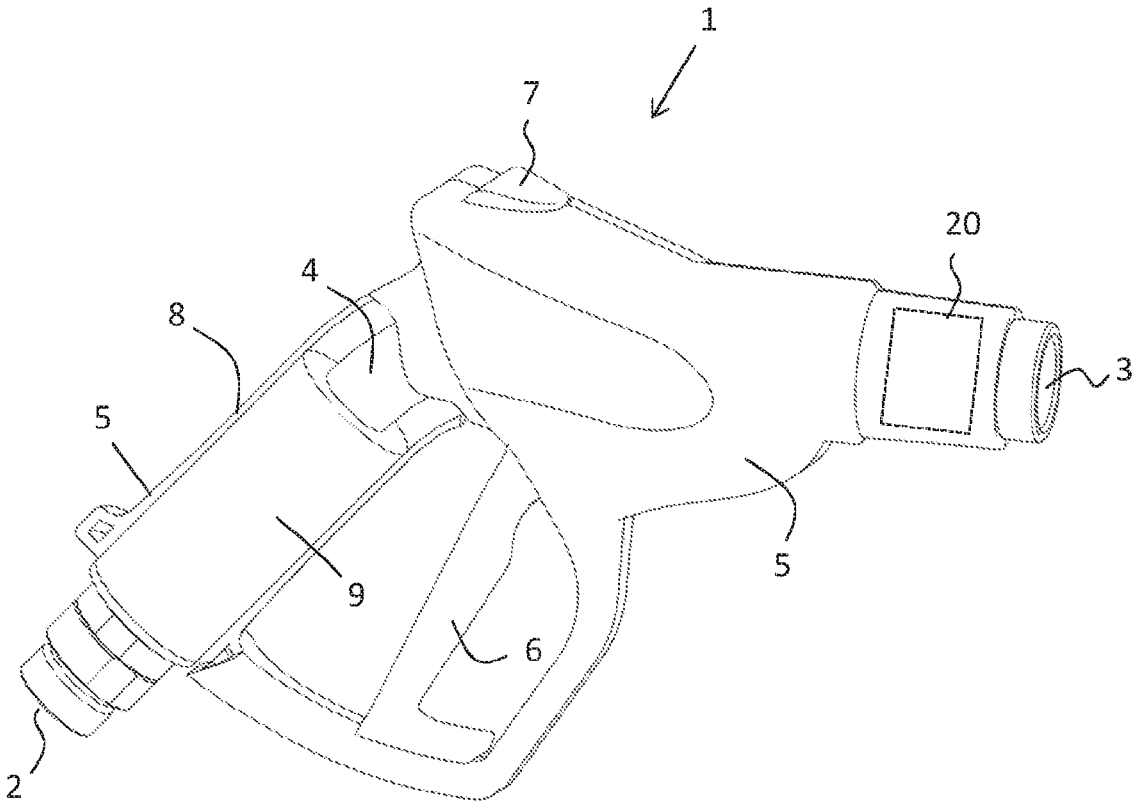
FIG. 1 schematically illustrates a perspective view of a dispensing gun wherein a part of the housing has been cut out.

FIG. 1 schematically illustrates a dispensing gun 1 comprising an inlet 2 adapted to be connected to a liquid dispensing hose or any other means of a refuelling facility, or the like, for supply of a liquid (to be dispensed by the dispensing gun) to said dispensing gun. For example, an inlet swivel for connection to a fuel dispenser hose may be arranged at the inlet of the dispensing gun. The dispensing gun furthermore comprises an outlet 3 from which the liquid exits the dispensing gun during dispensing to a recipient. The outlet is therefore adapted to be inserted into and/or connected to a recipient of a liquid to be dispensed by the dispensing gun. The dispensing gun also comprises an outlet valve arrangement 20 at or close to the outlet, which outlet valve arrangement controls the outflow of the liquid to be dispensed and furthermore preferably ensures that no liquid can be dispensed unless the dispensing gun is firmly connected to a coupling member of a recipient in a liquid tight manner. The liquid to be dispensed flows from the inlet to the outlet via a central body piping 4 which thus forms the main flow path inside the dispensing gun. The central body piping may be a single pipe or constitute a plurality of pipe sections without departing from the scope of the present invention. The outlet valve arrangement (not shown) is arranged at an outlet end of the central body piping.

The outlet valve arrangement may be any previously known outlet valve arrangement, and may for example comprise at least one poppet valve, different flow chambers and/or ventilation chambers where appropriate.

The dispensing gun may also comprise mechanical actuation means for regulating the flow of the liquid to be dispensed, such as in the form of a lever 6 adapted to be operated by a user, as known in the art. The invention is however not limited to any such means and dispensing of liquid can for example be controlled by electronic means only or in combination with mechanical actuation means of the dispensing gun as known in the art. Furthermore, in case of a dispensing gun which is adapted to be firmly secured to a coupling body of a recipient during dispensing of liquid, the dispensing gun may also comprise means for establishing a firm and liquid-tight coupling between the dispensing gun and a coupling body of a recipient before start of and during the dispensing procedure, as well as means for releasing the coupling of the dispensing gun to a coupling body of the recipient when the dispensing procedure has been terminated. Such means for releasing may for example comprise a release button 7 or the like. Such coupling means and release means are previously known in the art and will therefore not be discussed in further detail in the present disclosure.

The internal components of the dispensing gun are suitably protected against mechanical impact or other damages and/or impurities by a housing 5 as known in the art. The housing may also serve as a handle of the dispensing gun. In FIG. 1, a part of said housing, in a portion 8 of the dispensing gun which is adapted to be gripped by a user (hereinafter referred to as a gripping portion), has been cut out to show the internal components in said portion.

In accordance with the present invention, the dispensing gun 1 comprises an expansion chamber 9 which is separated from and arranged at a distance from the outlet valve arrangement such that it does not constitute a part of said outlet valve arrangement. It is furthermore separated from the main flow path 10 (shown for example in FIG. 2*a*) of the dispensing gun 1, and hence not arranged inside the central body piping. Thus, the expansion chamber is as such not intended to constitute a through-flow path of the liquid from the inlet 2 to the outlet 3 during a dispensing operation. The expansion chamber 9 is however adapted to allow liquid possibly accumulated therein between two dispensing operations to exit the expansion chamber and to enter into the main flow path 10 during a dispensing procedure such that it can be dispensed from the dispensing gun. The expansion chamber is arranged inside the housing 5 and may suitably be in a gripping portion 8 of the dispensing gun as shown in FIG. 1.

FIGS. 2*a* and 2*b* more clearly illustrate one embodiment of the expansion chamber 9. In order to illustrate the embodiment and clearly show the different features and components arranged in the expansion chamber, a part of the outer wall of the expansion chamber as well as a part of the wall of the central body piping have been cut out in FIG. 2*a*.

The purpose of the expansion chamber 9 is to allow liquid which is present inside the central body piping 4 (such as trapped between the inlet and the outlet valve arrangement) between two dispensing operations to enter the expansion chamber if it should expand, for example due to an increase of temperature. Thereby it can be ensured that the pressure inside the central body piping does not increase to a degree where it could possibly damage other components of the dispensing gun, such as the outlet valve arrangement. When the liquid expands, it is allowed to flow into the expansion chamber via at least one through-hole 11, suitably two or three through-holes, arranged in the wall of the central body piping 4.

The expansion chamber preferably comprises a piston 12 which is adapted to be movable in a first direction in response to an expansion of liquid contained in the central body piping 4. Thus, the piston 12 moves in the first direction by the pressure exerted by the liquid which enters the expansion chamber 9. In order to make sure that the liquid is only present on one side on the piston 12 inside the expansion chamber, the piston is preferably sealed against the walls of the expansion chamber 9 by sealing means, such as one or more O-rings 13 or other sealing means as known in the art. When the expansion chamber is arranged as shown in FIGS. 2*a* and 2*b*, the first direction of movement of the piston is essentially opposite and parallel to the flow direction of liquid which would occur in the main flow path during dispensing. The first direction is in FIG. 2*b* illustrated by arrow P1 and the flow direction in the main flow path is illustrated by arrow F.

The piston 12 is preferably spring loaded such that it is moveable in response to an increased force provided by the expanding liquid entering the expansion chamber 9 and is adapted to return to its original position by movement in a second direction P2 (shown in FIG. 4*a*) when the pressure from the liquid decreases, such as when the temperature decreases or when the outlet valve arrangement is opened during a dispensing procedure. As shown in FIGS. 2*a* and 2*b*, the spring may be a helical spring 14. However, other types of springs are also plausible. The same effect may also be achieved for example by a resilient element, such as a compressible rubber bus or the like, which in turn may provide a spring force to the piston 12 which enables it to return to its original state when the pressure of the expanded liquid is decreased, for example at the start of a new dispensing operation or as a result of a decrease of ambient temperature.

The spring force acting on the piston, provided for example by the spring 14, is preferably tailored such that liquid is essentially prevented from entering the expansion chamber during a dispensing procedure and preferably also under normal pressures between two dispensing procedures, i.e. when the liquid in the main flow path has not expanded or only slightly expanded. Moreover, it is preferred that the size of the through-hole 11 in the main body piping is tailored to the spring load provided to the piston in order to further ensure that liquid essentially does not flow from the main flow path 10 into the expansion chamber 9 during a dispensing operation. The appropriate size of the through-hole(s) depends for example on the pressure with which the dispensing operation is conducted and the viscosity of the liquid to be dispensed, and can easily be determined by the skilled person by for example empirical studies.

In order to save space, the expansion chamber 9 is arranged inside the housing 5 of the dispensing gun 1, preferably close to the inlet 2 as shown in FIG. 1 since in most cases there are few additional components inside this part of the housing 5 other than the central body piping and the means for connecting the dispensing gun to the means for delivery of liquid to the dispensing gun. This is also advantageous from the perspective that it is far removed from the outlet valve arrangement. This portion of the housing often corresponds to the gripping portion of the dispensing gun.

According to one embodiment, the expansion chamber 9 is arranged concentrically with the central axis of the central body piping 4 and radially outside the central body piping 4 as shown for example in FIGS. 2*a* and 2*b*, and is thus essentially in the form of a hollow cylinder. This also saves space and thus avoids making a bulky dispensing gun which could be difficult to handle by a user. For the same purpose, it is preferred that an outer surface of the central body piping at least partially forms a first wall of the expansion chamber. This furthermore saves space and the weight of the dispensing gun can be kept low as the central body piping and the expansion chamber shares the same wall. Moreover, it facilitates the fluid connection between the expansion chamber 9 and the main flow path 10 as the through-hole(s) 11 can easily be arranged in the shared wall.

In an alternative embodiment (not shown in the Figures), the expansion chamber 9 may be a completely separate unit with walls separated from the central body piping 4. In such a case, a tubing or the like connecting the through-hole 11 of the central body piping and an inlet/outlet of the expansion chamber for the liquid is needed. Such an embodiment is however less preferred since it may reduce the possible volume of the expansion chamber and may increase the weight of the dispensing gun. It may also in some cases result in a more bulky dispensing gun.

FIGS. 2*a* and 2*b* illustrates one embodiment of the expansion chamber 9 and when the piston 12 is in a first and original position. This first position of the piston 12 corresponds to a state where liquid inside the main flow path has not expanded and thus not entered into the expansion chamber, or a state wherein the liquid has just started to flow into the expansion chamber. In this first state, the spring is in a rested state.

As shown in FIGS. 2*a* and 2*b*, the at least one through-hole 11 can preferably be arranged in an upper portion of the expansion chamber. In this context, an upper portion refers to a portion which, in comparison to the opposite end of the expansion chamber, is arranged downstream as seen in the flow direction inside the main flow path. That is, the upper portion of the expansion chamber refers to a portion which is closer to the outlet of the dispensing gun than a lower portion of the expansion chamber. In the embodiment shown in FIGS. 2*a* and 2*b*, expanding liquid would thus enter the expansion chamber in an upper portion thereof forcing the piston to move downward against the spring load provided by the spring 14.

Even though FIGS. 2*a* and 2*b* illustrates an embodiment wherein the opening of the through-hole 11 in the central body piping 4 into the expansion chamber 9 is arranged above an upper essentially radial end surface of the piston 12 when it is in its original position, it is also possible to arrange the piston such that it essentially covers the through-hole when the piston is in its original position. This can be achieved by arranging the piston 12 such that a small gap exists between the piston and the wall of the expansion chamber 9 where the opening of the though hole 11 is arranged. Such a gap can for example be secured by means of selecting the appropriate size of an O-ring 13 arranged on the outer surface of the piston 12 (in the same manner as shown in FIGS. 2*a* and 2*b*) which faces the wall of the expansion chamber but below the opening of the through hole. It is also possible to ensure the size of the gap by a radial protrusion on the piston if desired.

In order to avoid pressure build-up on the underside of the piston when it is moved downwards, the expansion chamber preferably comprises at least one ventilation hole 15 arranged in or close to a bottom of the expansion chamber 9 to thereby allow escape of air if needed. The O-ring(s) 13 arranged on the outer side surface of the piston 12 ensure that liquid is unable to escape from a region above the piston 12, i.e. the first portion of the expansion chamber 9, to a region below the piston and through the ventilation hole(s) to the surrounding environment.

Even though FIGS. 2*a* and 2*b* shows an embodiment wherein the at least one through-hole 11 opens into the expansion chamber in an upper portion thereof, it is also plausible to arrange the at least one through-hole such that it opens into the expansion chamber 9 in a lower portion of the expansion chamber. In such a case, the piston would move upwards by the liquid entering the expansion chamber and return to its original position by the spring force. Naturally, such an embodiment could also comprise at least one ventilation hole 15 which would then be arranged in an upper portion of the expansion chamber 9.

Figure 3:
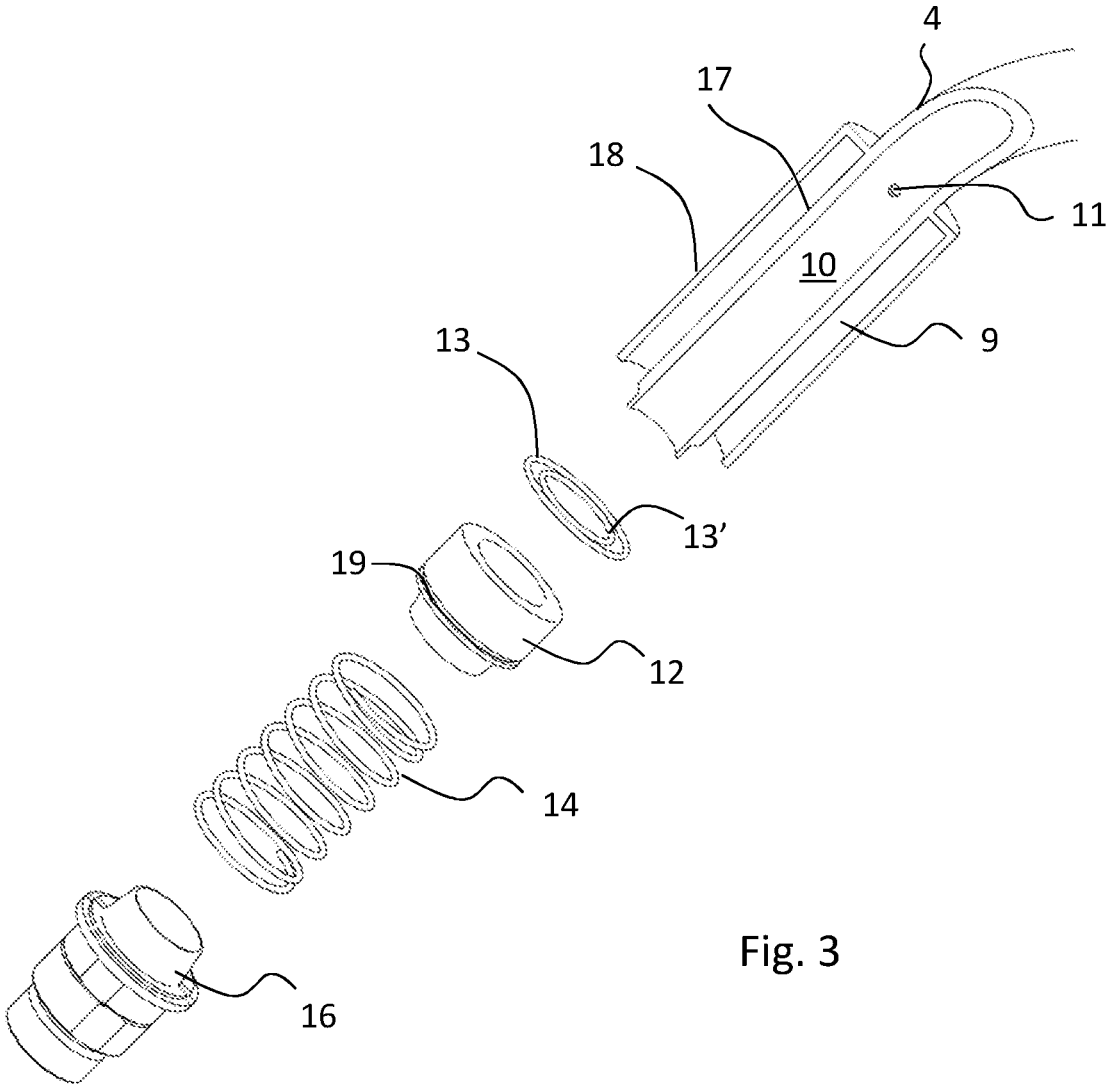
FIG. 3 schematically illustrates an exploded view of an expansion chamber.

FIG. 3 constitutes an exploded view of the expansion chamber 9 (as shown in FIGS. 2*a* and 2*b*) wherein the different components are shown. As can be seen from the figure, an outer surface 17 of a part of the central body piping 4 forms an inner surface of the expansion chamber 9 as the expansion chamber shares a wall with the central body piping. The expansion chamber further comprises an outer wall 18 which is arranged radially outside of the central body piping 4. Thus, the expansion chamber is concentric with a central axis of the central body piping 4 of the dispensing gun. Furthermore, the piston 12 has an essentially circular cylindrical shape with a central hole having a diameter which essentially corresponds to the diameter of the inner surface of the expansion chamber which is the same as an outer surface of the central body piping. Furthermore, the piston 12 preferably comprises a circumferential groove 19 in the axially arranged outer surface thereof, the groove 19 adapted for securing the location of an outer O-ring 13. The outer O-ring 13 has the purpose of providing a liquid tight seal between the piston 12 and the outer wall 18 of the expansion chamber 9. This piston preferably comprises a corresponding groove on an axially arranged inner surface for securing the position of an inner O-ring 13'. The inner O-ring 13' is adapted for providing a seal between the piston and the inner wall of the expansion chamber. The piston with the O-rings thus divides the expansion chamber into a first portion adapted for temporarily accommodating liquid and a second portion which will not accommodate any liquid. Thus, the first portion of the expansion chamber is liquid tight except for the fluid communication with the main flow path.

The spring 14 may suitably be provided between the piston and essentially a bottom portion of the expansion chamber 9. As shown in FIG. 3, the bottom portion of the expansion chamber may be a part of a member 16 adapted for attachment to a connecting means for connecting the dispensing gun to means for delivering liquid to the dispensing gun, for example an inlet swivel.

FIGS. 4*a* and 4*b* show the expansion chamber as shown in FIGS. 2*a* and 2*b*, but in a second state. The second state constitutes a state wherein expanded liquid from the main flow path of the dispensing gun has entered into the expansion chamber and forced the piston downwards to its second position. Thus, the spring 14 is in a compressed state. The piston 12 may return to its original position by movement in a second direction, as illustrated by arrow P2, when the pressure from the liquid inside the expansion chamber decreases. The piston further facilitates the escape of liquid from the expansion chamber back into the main flow path such that it can be dispensed from the dispensing gun via its outlet.

The invention according to the present disclosure is not limited to the embodiment shown in the figures. For example, the expansion chamber need not be concentrically arranged with the central axis of the central body piping, but can for example be a separate chamber arranged on only one side of the central body piping. Furthermore, the piston may not necessarily be arranged such that it is movable in a direction which is essentially opposite to the flow direction of the liquid during a dispensing procedure, but may for example instead be in a direction which is essentially parallel to the flow direction during a dispensing procedure. Furthermore, the piston need not necessarily be spring loaded. Instead, a separate resilient member, such as a rubber member, can be arranged on one side of the piston to provide a desired resilient force for the piston. Moreover, it is plausible to include other types of arrangements for the return of the piston to its original position. Such means may for example be controlled by the electronics and actuated at the start of a dispensing procedure to thereby force the piston to its original position and thereby force liquid contained in the expansion chamber to exit the expansion chamber and enter into the main flow path. Furthermore, in an embodiment wherein the expansion chamber does not comprise a piston, the expansion chamber and its fluid connection to the central body piping can be arranged such that a pressure gradient arising between the expansion chamber and the main flow path inside the central body piping ensures that liquid contained in the expansion chamber is sucked out or pressed out of the expansion chamber during a dispensing operation. The walls of expansion chamber may preferably be made of a solid material which is not adapted to change its geometrical form when subjected to pressure differences. However, it is also possible to include an inflatable element, for example a balloon-like expansion chamber, in embodiments where no piston is used.

The invention claimed is:

1. A dispensing gun comprising:

an inlet adapted to be connected to a device for delivering liquid to the dispensing gun, an outlet adapted to be inserted into and/or connected to a recipient of a liquid to be dispensed by the dispensing gun, a housing, a central body piping forming a main flow path for the liquid to be dispensed from the inlet to the outlet, an outlet valve arrangement arranged at or in proximity of the outlet, and an expansion chamber arranged inside the housing, said expansion chamber being separated from the main flow path and from the outlet valve arrangement, the expansion chamber being in liquid communication with the main flow path via at least one through-hole in the central body piping to allow liquid to enter said expansion chamber in case of expansion of liquid contained in the main flow path, the expansion chamber being in the form of a hollow cylinder arranged concentrically with a central axis of the central body piping and radially outside the central body piping, and the expansion chamber further comprising a piston moveable in a first direction in response to an expansion of liquid contained in the main flow path, wherein the piston includes a central hole having a diameter corresponding to an inner surface of the expansion chamber, and wherein the expansion chamber does not operate as a through-flow path for the liquid from the inlet to the outlet during a dispensing operation.

2. The dispensing gun according to claim 1, wherein the expansion chamber is divided into a first portion adapted to receive liquid from the main flow path in case of expansion of liquid contained in the main flow path and a second portion adapted to not receive any liquid from the main flow path, wherein the piston forms a dividing wall between the first portion and the second portion.

3. The dispensing gun according to claim 1, wherein the piston is spring loaded.

4. The dispensing gun according to claim 1, wherein an outer surface of the central body piping at least partially forms a first wall of the expansion chamber.

5. The dispensing gun according to claim 4, wherein said at least one through-hole in the central body piping is arranged in said first wall of the expansion chamber.

6. The dispensing gun according to claim 5, wherein the at least one through-hole is arranged in said first wall such that it opens into upper portion of the expansion chamber.

7. The dispensing gun according to claim 5, wherein the at least one through-hole is arranged in said first wall such that it opens into a lower portion of the expansion chamber.

8. The dispensing gun according to claim 1, wherein the piston is adapted to be located essentially over the at least one through-hole during a dispensing procedure.

9. The dispensing gun according to claim 2, wherein the expansion chamber comprises at least one ventilation hole arranged in a wall of the expansion chamber, wherein said ventilation hole arranged in said second portion adapted to not receive any liquid from the main flow path.

10. The dispensing gun according to claim 1, wherein the piston is provided with a sealing mechanism, to provide a liquid tight seal between the piston and a wall of the expansion chamber.

11. The dispensing gun according to claim 3, wherein the piston is spring loaded by means of a spring.

12. The dispensing gun according to claim 10, wherein said sealing mechanism comprises at least one O-ring.

* * * * *